US008246380B2

(12) United States Patent
Hsieh et al.

(10) Patent No.: US 8,246,380 B2
(45) Date of Patent: Aug. 21, 2012

(54) CONNECTING DEVICE

(75) Inventors: Chung-Cheng Hsieh, Taipei Hsien (TW); Li-Ping Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 136 days.

(21) Appl. No.: 12/903,730

(22) Filed: Oct. 13, 2010

(65) Prior Publication Data

US 2011/0306233 A1 Dec. 15, 2011

(30) Foreign Application Priority Data

Jun. 10, 2010 (CN) ..... 2010 1 0196986

(51) Int. Cl.
*H01R 13/72* (2006.01)

(52) U.S. Cl. ..... 439/501; 174/99 R

(58) Field of Classification Search ..... 439/501, 439/4, 131; 174/69, 99 R
See application file for complete search history.

(56) References Cited

U.S. PATENT DOCUMENTS 7,494,350 B1 * 2/2009 Lee ..... 439/131
7,871,291 B2 * 1/2011 Tracy et al. ..... 439/501
8,003,887 B1 * 8/2011 Hsieh et al. ..... 174/69
8,038,468 B2 * 10/2011 Lu ..... 439/501

* cited by examiner

*Primary Examiner* — Xuong Chung Trans
(74) *Attorney, Agent, or Firm* — Altis Law Group, Inc.

(57) ABSTRACT

A connecting device includes a cable transmitting a signal, a carrier receiving the cable, a sliding member slidable on the carrier, and a resilient component. The carrier includes a first side plate and a second side plate opposite to the first side plate, and a fixing post is secured in the carrier adjacent to the first side plate. The resilient component is secured to the fixing post and the sliding member, and the cable runs between the fixing post and the sliding member, wherein the resilient component is elastically deformable between a first state and a second state. In the first state, the resilient component is in an original state, substantially all of the cable is in the carrier, and the sliding member abuts the second side plate. In the second state, the resilient component is in elastically deformed, substantially all of the cable is exposed from the carrier, and the sliding member slides adjacent to the first side plate.

12 Claims, 7 Drawing Sheets

CONNECTING DEVICE

BACKGROUND

1. Technical Field

The present disclosure relates to a connecting device for connecting two electronic components of an electronic device.

2. Description of Related Art

Generally, a cable is configured for connecting electronic components, such as a hard disk, a motherboard, or an optical disk drive. The cable normally has a surplus portion when connected to the electronic components in order to assure the different distances between each component. The surplus portion of the cable takes up a lot of space between the electronic components and is usually disorderly placed in the electronic device.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
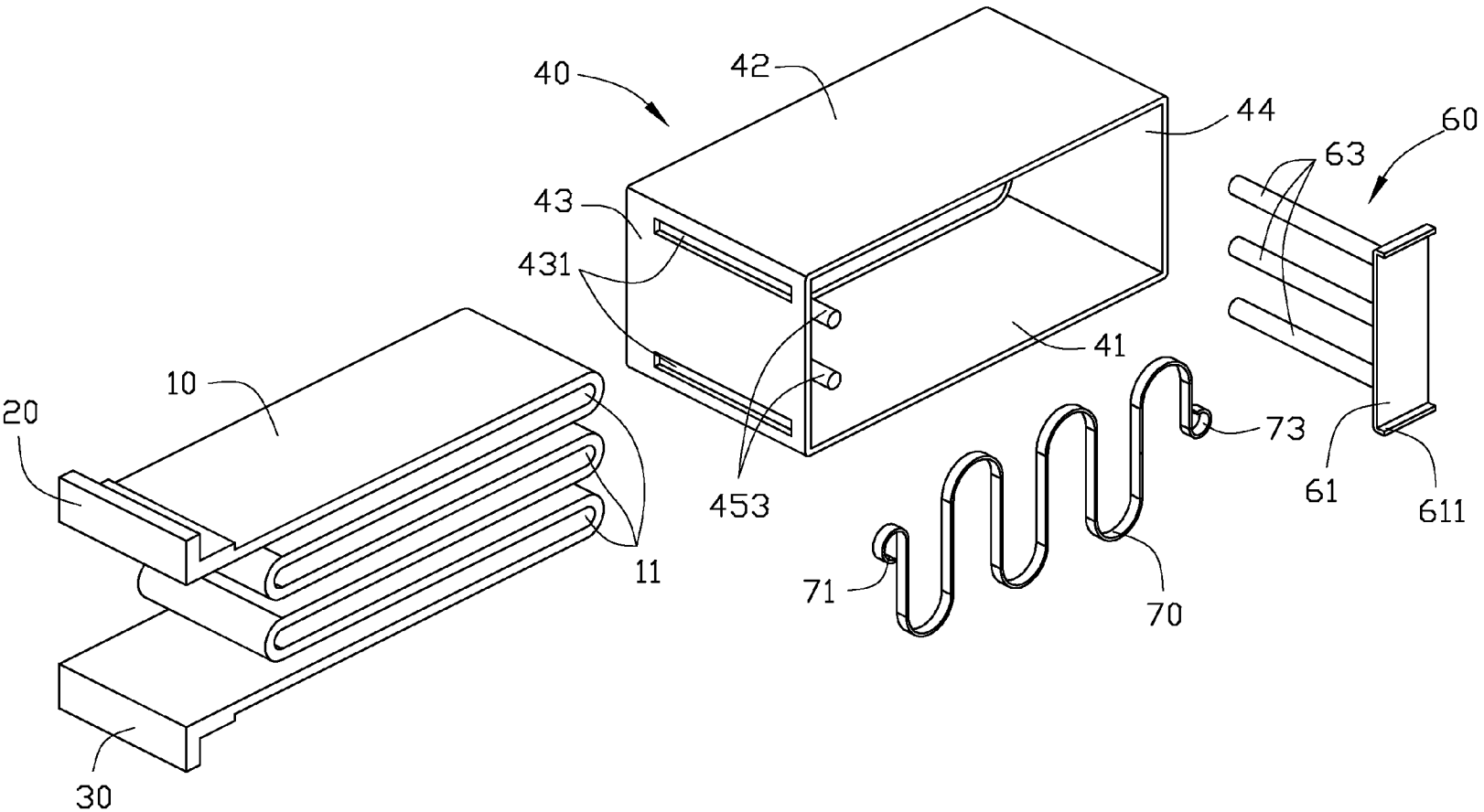
FIG. 1 is an exploded, isometric view of a connecting member in accordance with an embodiment.
Figure 2:
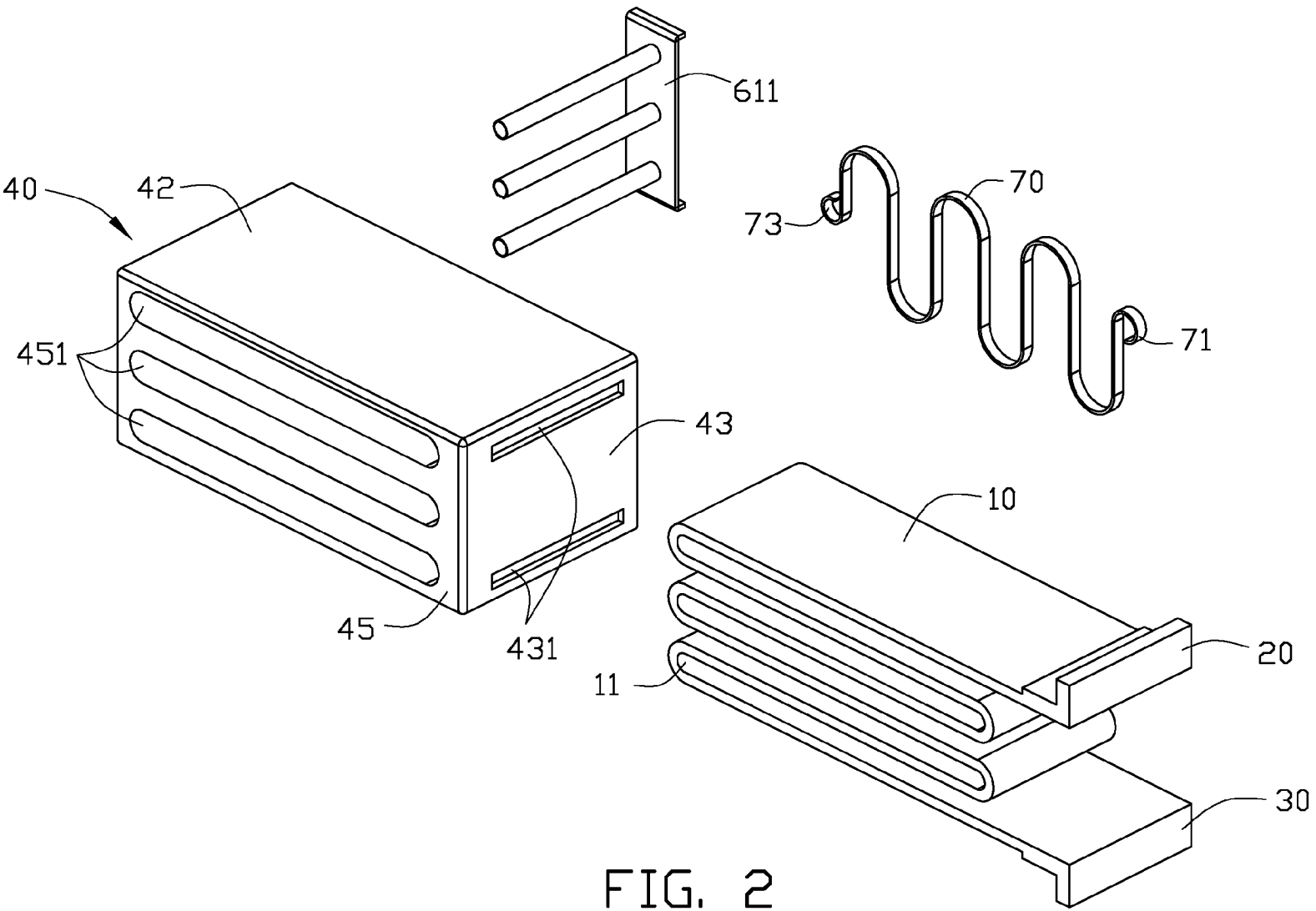
FIG. 2 is similar to FIG. 1, but viewed from a different aspect.

Referring to FIG. 1 and FIG. 2, a connecting member in accordance with an embodiment includes a cable 10 for transmitting signals, a first connector 20, a second connector 30, a carrier 40 receiving the cable 10, a sliding member 60, and a resilient component 70. In one embodiment, the cable 10 can be a ribbon cable.

The first connector 20 and the second connector 30 are electrically secured to the two ends of the cable 10.

The carrier 40 includes a bottom plate 41, a top plate 42, a first side plate 43, a second side plate 44, and a rear plate 45. In one embodiment, a top plate 42 is substantially parallel to the bottom plate 41, and the first side plate 43 is substantially parallel to the second side plate 44 and perpendicular to the bottom plate 41. Two through holes 431 are defined in the first side plate 43, for the cable 10 to pass through. In one embodiment, the two through holes 431 extend in the same direction. Three sliding slots 451 are defined in the rear plate 45, and two fixing posts 453 extend from the rear plate 45. In one embodiment, the two fixing posts 453 are substantially perpendicular to the rear plate 45, and each fixing post 453 is located between two adjacent sliding slots 451.

The sliding member 60 slides between the first side plate 43 and the second side plate 44 and includes a main body 61. Three positioning posts 63 are connected to the main body 61. In one embodiment, the main body 61 is rectangular, and two flanges 611 are extended from two shorter edges of the main body 61. The three positioning posts 63 are capable of being inserted into the three sliding slots 541. In one embodiment, the three positioning posts 63 are substantially perpendicular to the main body 61.

The resilient component 70 includes a first end 71 and a second end 73. In one embodiment, the resilient component 70 is an elastic piece with a wave shape. The first end 71 is secured to one of the two fixing posts 453, and the second end 73 is secured to one of the three positioning post 63. In one embodiment, the first end 71 is secured to the one fixing post 453, which is adjacent to the top plate 42, and the second end 73 is secured to a center positioning post 63.

Figure 3:
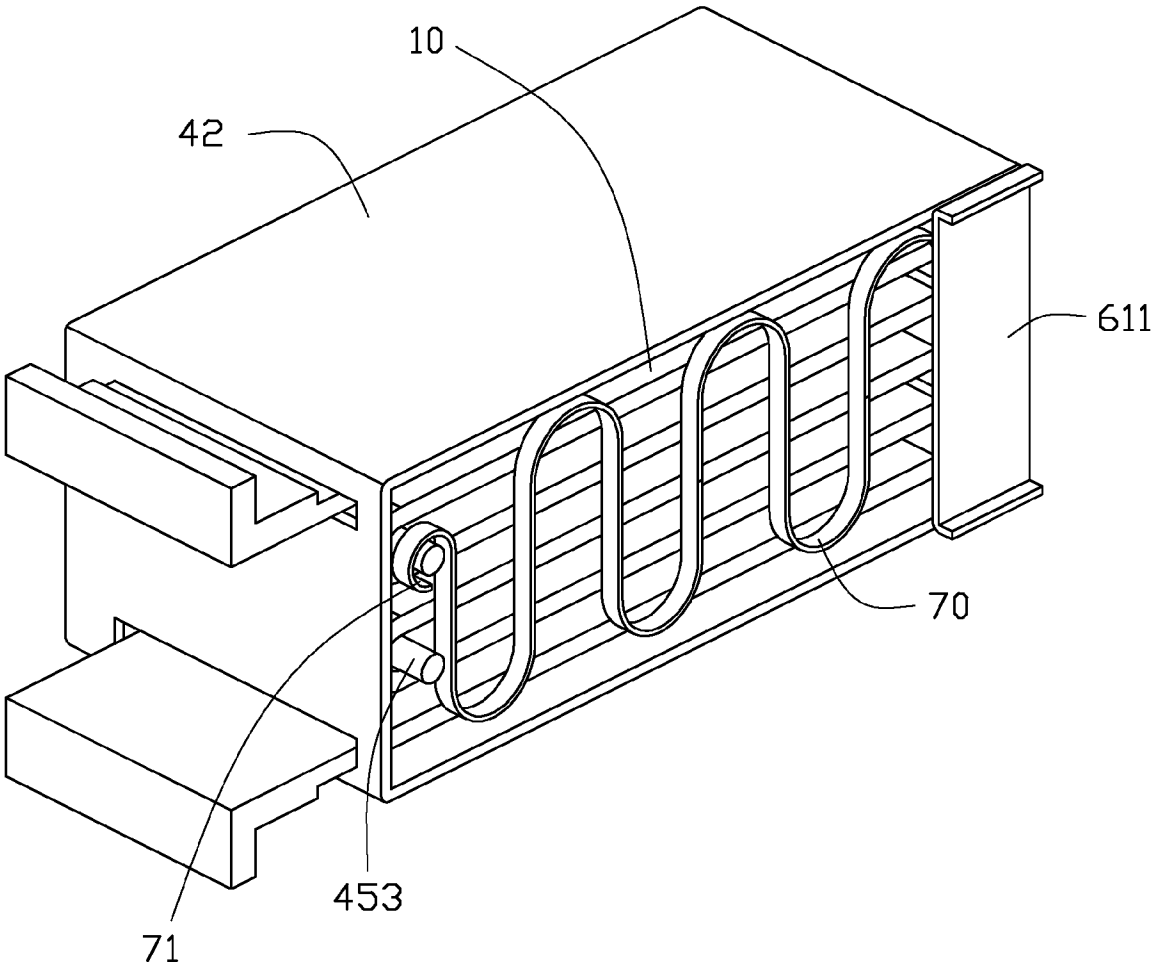
FIG. 3 is an assembled view of FIG. 1.

Referring to FIG. 3, in assembly, the cable 10 is inserted in the carrier 40 through an upper through hole 431 of the first side plate 43 in a first direction substantially parallel to the top plate 42. When the cable 10 extends adjacent to the second side plate 14, the cable 10 is wrapped and directed in a second opposite direction. The cable 10 further extends in the second opposite direction, and encircles an upper fixing post 453, when the cable 10 extends back to the first side plate 43. Accordingly, the cable 10 runs between the fixing posts 453 and the positioning posts 63, and two ends of the cable 10 extend out of the two through holes 431 of the first side plate 43. Three slots 11 are formed on the cable 10 (FIG. 1).

The first end 71 of the resilient component 70 is secured to the fixing post 453, and the second end 73 of the resilient component 70 is secured to the positioning post 63. The three positioning posts 63 pass through the three slots 11 of the cable 10 and are inserted into the three sliding slots 451. In this position, the resilient component 70 is in an original state, the cable 10 is located between the positioning posts 63 and the fixing posts 453, and the sliding member 60 abuts the second side plate 44. The first connector 20 is connected to an end of the cable 10, and is placed outside the carrier 40. The second connector 30 is connected to the other end of the cable 10, and is located outside the carrier 40.

Figure 4:
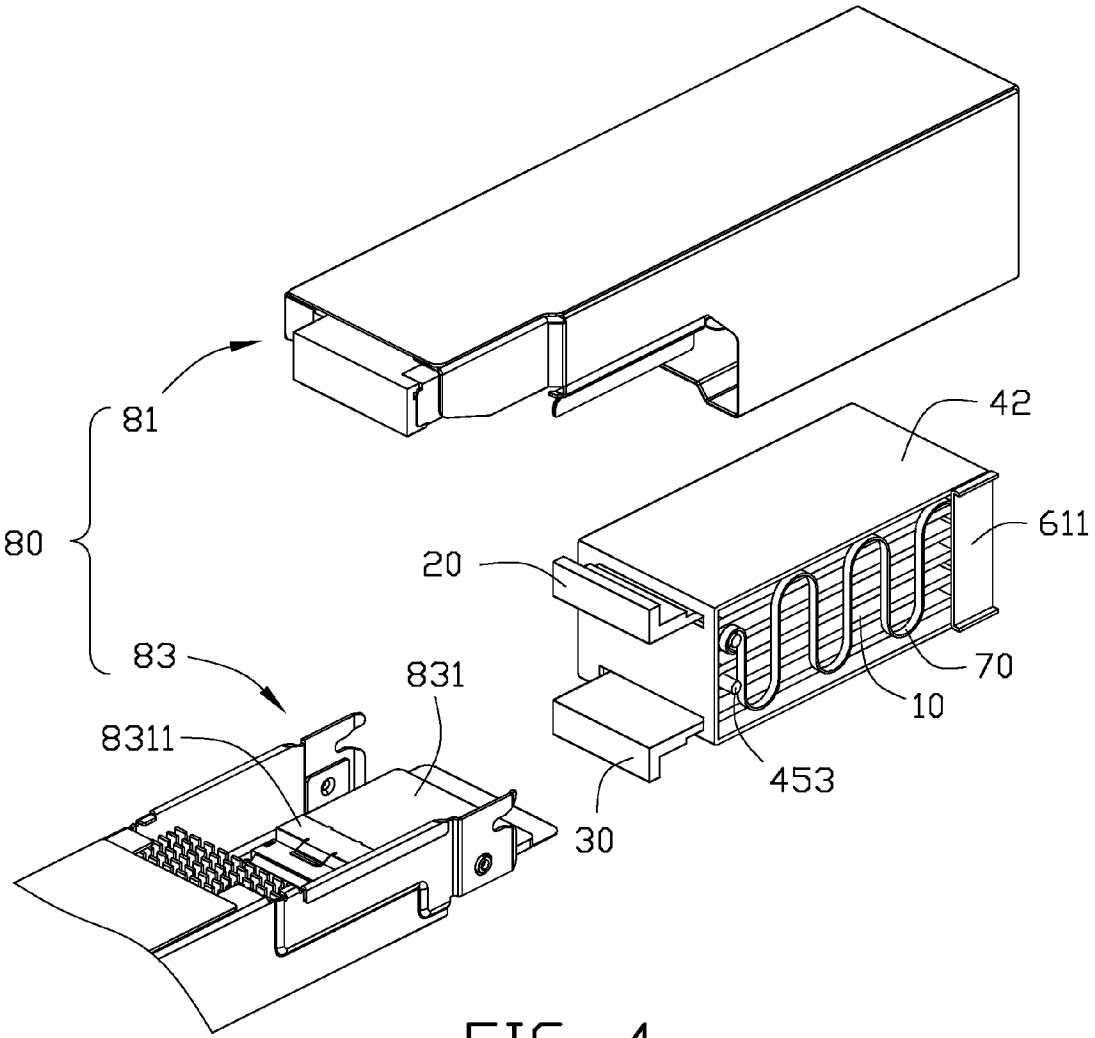
FIG. 4 is an exploded, isometric, cutaway view of the connecting device of FIG. 3 and an electronic device in accordance with an embodiment.

Referring to FIGS. 4, the connecting device connects an electronic device 80. In one embodiment, the electronic device 80 can be a computer or a server. The electronic device 80 includes a case 81 and a mounting tray 83. A first electronic component (not shown) is mounted in the case 81, configured to connect to the first connector 20. In one embodiment, the first electronic component could be a number of electronic components such as an input/output module. A circuit board 831 is secured on the mounting tray 83. A second electronic component 8311 is secured to the circuit board 831, configured for being connected to the second connector 30. In one embodiment, the second electronic component 8311 can be a storage device.

Figure 5:
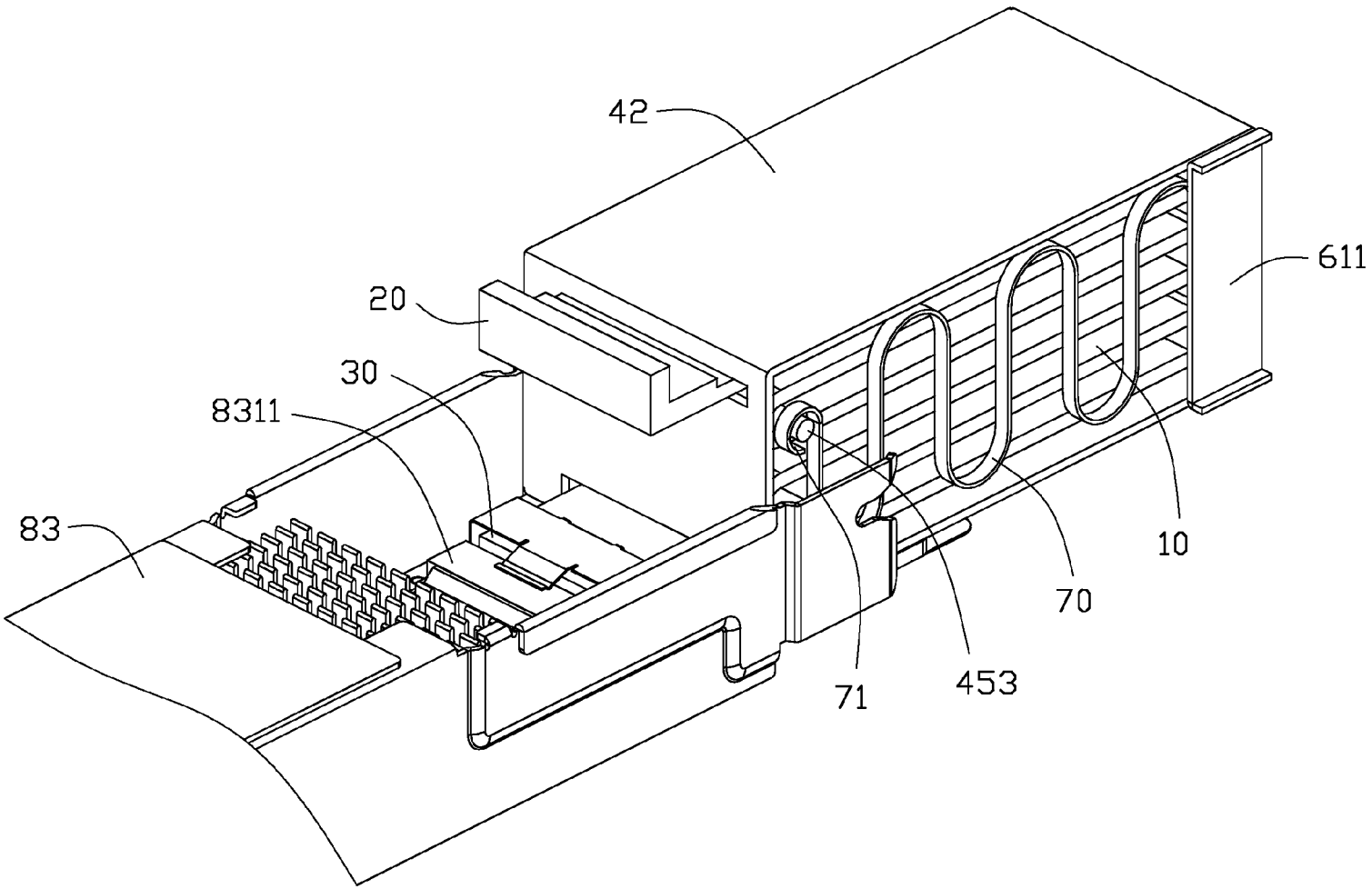
FIG. 5 is an assembled, cutaway view of the connecting device and a mounting tray of FIG. 4.
Figure 6:
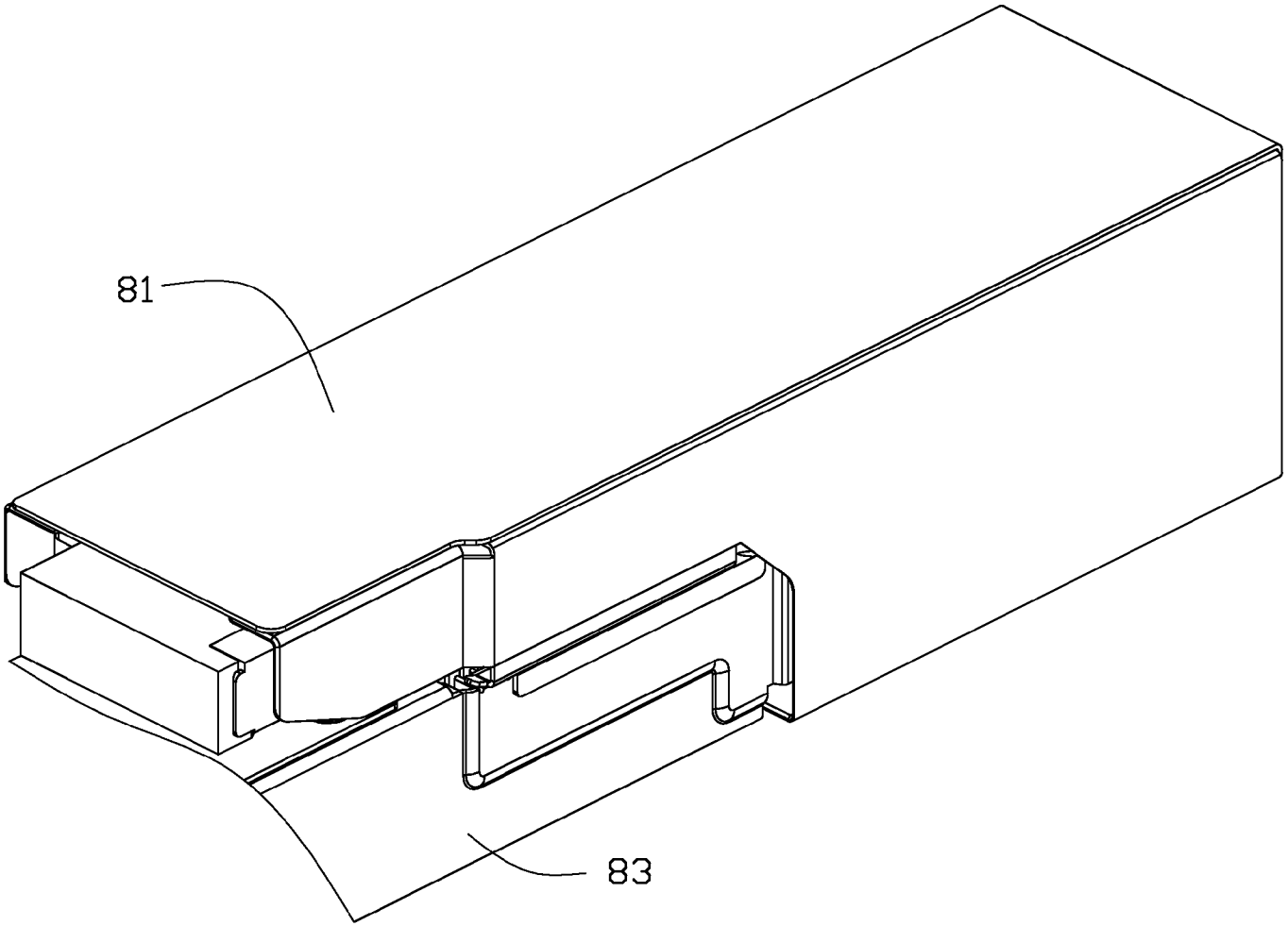
FIG. 6 is an assembled, cutaway view of FIG. 4.
Figure 7:
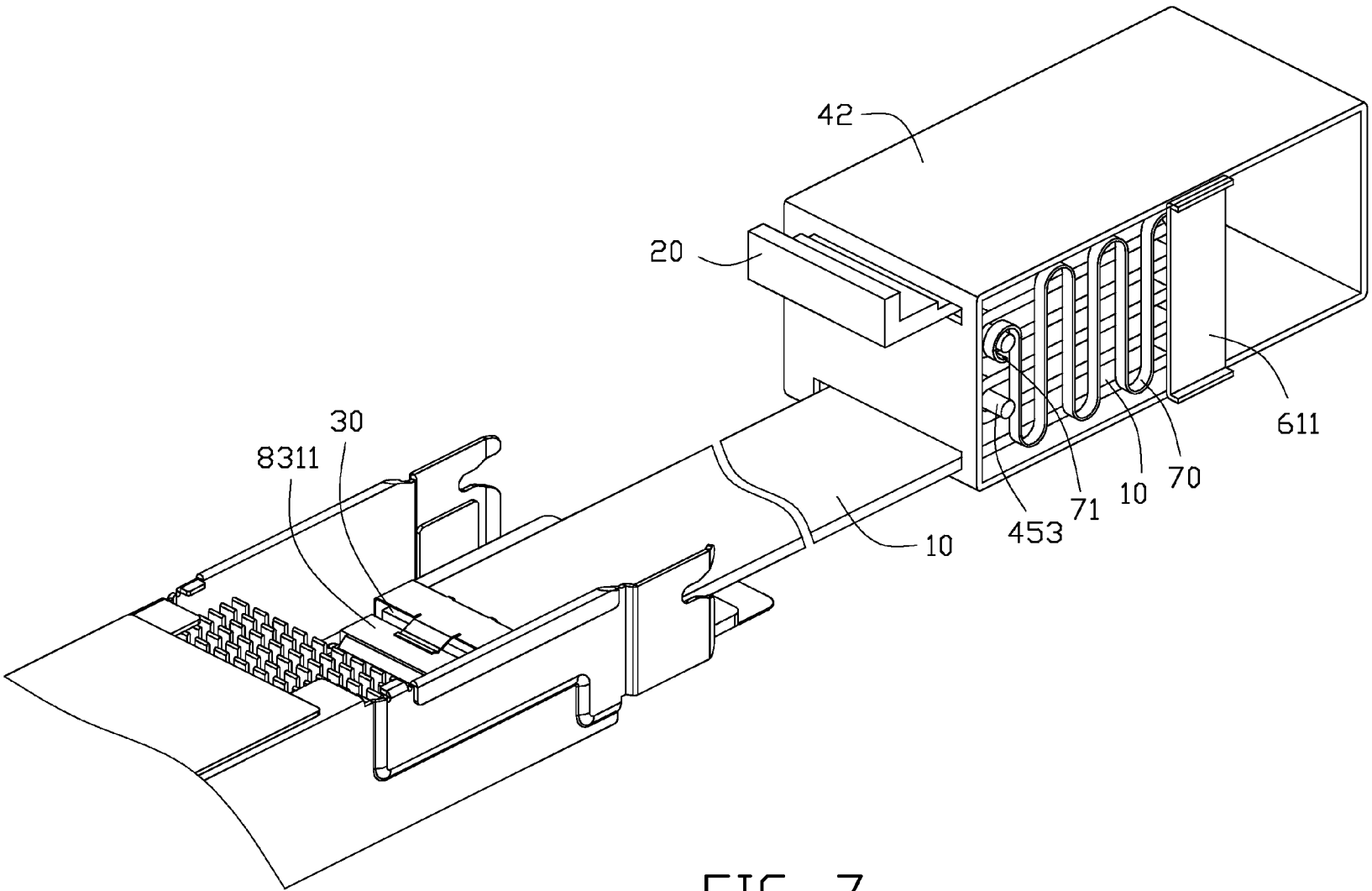
FIG. 7 is similar to FIG. 5, but shows the connecting device in a different position.

Referring to FIGS. 5-7, in use, the first connector 20 is connected to the first electronic component, and the second connector 30 is connected to the second electronic component 8311. Therefore, the cable 10 transmits signal between the first electronic component and the second electronic component 8311 of the electronic device 80. To see if the electronic component 8311 works, the mounting tray 83 needs to be moved away from the case 81, so the electronic component 8311 can be tested. At this time, in a second state, the sliding member 60 moves in a direction near the fixing posts 453, with the cable 10 extending, and each positioning post 63 respectively slides in each sliding slot 451 in a direction near to the fixing posts 453, to elastically deform the resilient component 70. The length of the cable 10 exposed from the carrier 40 becomes longer and longer, so that the cable 10 is capable of connecting the first electronic component to the second electronic component 8311. When the mounting tray 83 is replaced back into a enclosure (not shown), the resilient component 70 is resiliently deformed, to move the sliding member 60 in a direction away form the fixing posts 453. Thus, the cable 10 is moved to the carrier 40 with the resilient component 70, until the cable 10 returns to the original state.

In one embodiment, each positioning post 63 has a plastic roller (not shown) about it, and the cable 10 is wrapped about the plastic roller, and is capable of moving easily. In addition, the cable 10 is capable of extending when the resilient component is deformed and constricting when the resilient component rebound, because the resilient component 70 that is mounted on the fixing post 453 and the positioning post 63. Therefore, the cable 10 is not easily damaged when the first and second connectors 20 and 30 are connected to the first electronic component and the second electronic component 8311. The cable 10 is placed orderly in the carrier 40, and will not influence the air flow in the electronic device 80.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A connecting device comprising:

a cable configured to transmit signal;

a carrier receiving the cable, the carrier comprising a first side plate and a second side plate opposite to the first side plate, and a fixing post secured in the carrier adjacent to the first side plate;

a sliding member slidable in the carrier; and a resilient component secured to the fixing post and the sliding member, and the cable runs between the fixing post and the sliding member, wherein the resilient component is elastically deformable between a first state and a second state; in the first state the resilient component is in an original state, substantially all of the cable is in the carrier, and the sliding member abuts the second side plate; and in the second state, the resilient component is in elastically deformed, substantially all of the cable is exposed from the carrier, and the sliding member slides adjacent to the first side plate; wherein the cable wrapped about the sliding member in a first direction and wrapped about the fixing post in a second direction.

2. The connecting device of claim 1, wherein a sliding slot is defined in the carrier, and the sliding member comprises a positioning post slidably engaged in the sliding slot.

3. The connecting device of claim 2, wherein the sliding member further comprises a main body, and the positioning post is perpendicularly located on the main body.

4. The connecting device of claim 3, wherein the carrier comprises a bottom plate and a top plate parallel to the bottom plate, and the positioning post is located between the bottom plate and the top plate.

5. The connecting device of claim 1, wherein the carrier further comprises a rear plate connected to the first side plate, and the fixing post is perpendicular to the rear plate.

6. The connecting device of claim 1, wherein two through holes are defined on the first side plate, and the two through holes are configured for allowing the cable to pass through.

7. The connecting device of claim 1, further comprising a first connector and a second connector connected to the cable, and the cable is configured for electronically connecting two electronic components.

8. A connecting device comprising:

a cable configured to transmit signal;

a carrier comprising a first side plate, a second side plate opposite to the first side plate, and a rear plate connected to the first side plate and the second side plate, a through hole defined in the first side plate for the cable to pass through, a fixing post secured in the carrier and a sliding slot defined in the rear plate;

a sliding member comprising a positioning post for being inserted into the sliding slot of the rear plate, and the positioning post slidable between the first side plate and the second side plate; and a resilient component secured to the positioning post and the fixing post, wherein the resilient component is deformed when the positioning post is slid toward to the first side plate, and biases the positioning post to slide away from the second side plate;

wherein the cable wrapped about the sliding member in a first direction and wrapped about the fixing post in a second direction.

9. The connecting device of claim 8, wherein a fixing post perpendicularly extends from the rear plate, for securing a first end of the resilient component, and the fixing post abuts the first side plate.

10. The connecting device of claim 8, wherein the sliding member comprises a main body, and the positioning post is perpendicularly located on the main body.

11. The connecting device of claim 10, wherein the carrier comprises a top plate and a bottom plate parallel to the top plate, and the main body is located between the bottom plate and the top plate.

12. The connecting device of claim 8, further comprising a first connector and a second connector connected to the cable, and the cable is configured for electronically connecting two electronic components.

* * * * *